United States Patent [19]

Eda et al.

[11] 4,400,683

[45] Aug. 23, 1983

[54] VOLTAGE-DEPENDENT RESISTOR

[75] Inventors: Kazuo Eda, Hirakata; Masanori Inada, Nara; Michio Matsuoka, Ibaraki, all of Japan

[73] Assignee: Matsushita Electric Industrial Co., Ltd., Japan

[21] Appl. No.: 303,613

[22] Filed: Sep. 18, 1981

[51] Int. Cl.[3] ..... H01C 7/10

[52] U.S. Cl. ..... 338/21; 252/518; 252/519; 252/521; 338/309; 338/314

[58] Field of Search ..... 338/21, 20, 309, 314; 252/518, 519, 521; 29/610 R

[56] References Cited

U.S. PATENT DOCUMENTS

| | | | |
|---|---|---|---|
| 3,611,073 | 10/1971 | Hamamoto | 338/20 X |
| 3,689,863 | 9/1972 | Matsuoka et al. | 338/20 |
| 3,999,159 | 12/1976 | Matsuura et al. | 338/21 |
| 4,272,754 | 6/1981 | Lou | 338/21 |
| 4,296,002 | 10/1981 | Sokoly et al. | 338/20 |
| 4,319,215 | 3/1982 | Yamazaki et al. | 338/21 |

FOREIGN PATENT DOCUMENTS

| | | | |
|---|---|---|---|
| 52-66991 | 6/1977 | Japan | 338/21 |
| 764693 | 1/1957 | United Kingdom | 338/21 |

*Primary Examiner*—C. L. Albritton

*Attorney, Agent, or Firm*—Wenderoth, Lind & Ponack

[57] ABSTRACT

A voltage-dependent resistor having at least one zinc oxide (ZnO) layer adjacent to at least one metal oxide layer of bismuth oxide ($Bi_2O_3$) and at least one of the members selected from the group consisting of cobalt oxide ($Co_2O_3$) manganese oxide ($MnO_2$) antimony oxide ($Sb_2O_3$) and zinc oxide (ZnO).

5 Claims, 6 Drawing Figures

VOLTAGE-DEPENDENT RESISTOR

This invention relates to a voltage-dependent resistor (varistor) having non-ohmic properties (voltage-dependent property) due to the interface of hetero-junction. This invention relates more particulary to a voltage-dependent resistor, which is suitable for a surge and noise absorber.

The electrical characteristics of a voltage-dependent resistor is expressed by the relation:

$$I = \left(\frac{V}{C}\right)^n \quad (1)$$

where V is a voltage across the resistor, I is a current flowing through the resistor, C is a constant corresponding to the voltage at a given current and an exponent n is a numerical value greater than 1. The value of n is calculated by the following equation:

$$n = \frac{\log_{10}(I_2/I_1)}{\log_{10}(V_2/V_1)} \quad (2)$$

where $V_1$ and $V_2$ are the voltages at given currents $I_1$ and $I_2$, respectively. The value of n is desired to be as large as possible because this exponent determines the extent to which the resistors depart from ohmic characteristics.

Recently, semiconductor devices, especially micro-computers, have been widely used in electronic circuits. Those micro-computers have a drawback in that they are vulnerable to surges (abnormally high voltage). Furthermore, the micro-computers are likely to work in the wrong due to noises (high frequency abnormal voltage).

As an absorber for surges and noises, zener diodes, zinc oxide voltage-dependent resistors and filters are known. Zener diodes have large n-values. Therefore, they can absorb surges in the electronic circuits. However, in order to absorb the noises, a large capacitance is necessary. The zener diodes do not have a large capacitance enough to absorb the noises. Therefore, in order to absorb the noises, too, a noise absorber is necessary in addition to the zener diodes.

There have been known, on the other hand, voltage-dependent resistors of the bulk-type comprising a sintered body of zinc oxide with additives, as seen in U.S. Pat. Nos. 3,633,458, 3,632,529, 3,634,337, 3,598,763, 3,682,841, 3,642,664, 3,658,725, 3,687,871, 3,723,175, 3,778,743, 3,806,765, 3,811,103, 8,936,396, 3,863,193, 3,872,582 and 3,953,373. These zinc oxide voltage-dependent resistors of the bulk-type contain, as additives, one or more combinations of oxides or fluorides of bismuth, cobalt, manganese, barium, boron, berylium, magnesium, calcium, strontium, titanium, antimony, germanium, chromium, and nickel, and the C-value is controllable by changing, mainly, the compositions of said sintered body and the distance between electrodes, and they have an excellent voltage-dependent properties in an n-value.

Conventional zinc oxide voltage-dependent resistors have so large n-values that they were expected to be a surge absorber. However, zinc oxide voltage-dependent resistors have problems to be solved in order to be applied to a surge and noise absorber for the micro-computers. The problems are C-value and the value of capacitance. Those are the most important problems to be solved in practice. When a zinc oxide voltage-dependent resistor is applied to surge and noise absorber for the micro-computers, the C-value should be less than 15 volts and the value of capacitance should be larger than 10 nF. This is because the operating voltage and the withstand voltage of the micro-computers are usually 5 V or less and about 15 V, respectively. Therefore, in order to protect the micro-computers from the surges, the C-value should be lower than 15 volts.

In order to absorb the noises, the value of capacitance should be above 10 nF. The capacitance of the zinc oxide varistor is proportional to the area of the electrodes. However, judging from the application to the microcomputers, the size should be small. Therefore, large capacitance per unit area is required such as 10 nF/cm$^2$ (100 pF/mm$^2$). The conventional zinc oxide voltage-dependent resistors do not have such a large capacitance per unit area and a low voltage at the same time.

On the other hand, filters for absorbing the noises are known. They are usually composed of networks of capacitors, resistors and inductors. They are useful for absorbing noises. However, they are useless for absorbing surges. Therefore, in order to absorb surges, a surge absorber is necessary in addition to the filter.

An object of the present invention is to provide a voltage dependent resistor having an enough n-value, a low C-value and a large capacitance per unit area, which can absorb both the surges and the noises by one-tip. The characteristics of high n-value, low C-value and large capacitance are indispensable for the application of one-tip surge and noise absorber.

This object and features of this invention will become apparent upon consideration of the following detailed description taken together with the accompanying drawings.

Before proceeding with detailed description of the manufacturing processes of the voltage-dependent resistors contemplated by this invention, their constructions will be described with reference to FIGS. 1 to 4.

Figure 1:
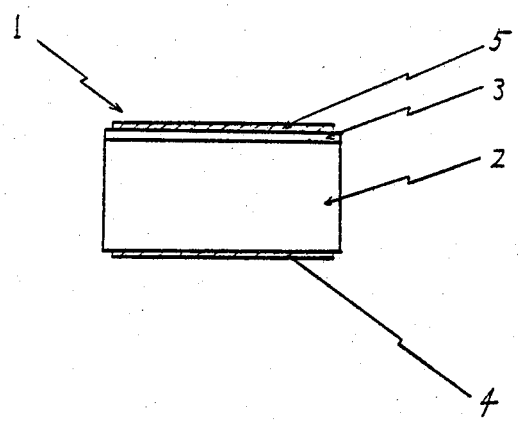
FIGS. 1 to 4 show cross-sectional views of four voltage-dependent resistors in accordance with this invention.

In FIG. 1, reference numeral 1 designates, as whole, a voltage-dependent resistor comprising, as its active element, a zinc oxide layer 2 having an electrode 4 and a bismuth oxide layer 3 having an electrode 5.

Figure 2:
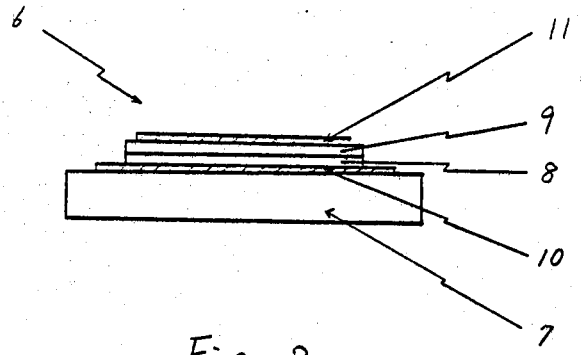

In FIG. 2, reference numeral 6 designates, as whole, a voltage-dependent resistor comprising, as its active element, a zinc oxide layer 8 having an electrode 10 on a substrate 7 and a bismuth oxide layer 9 having an electrode 11. Both FIGS. 1 and 2 show typical constructions of this invention having an asymmetric voltage-current characteristics as shown in FIG. 5.

Figure 3:
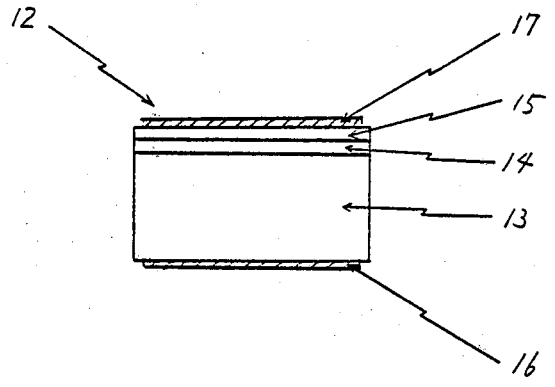

In FIG. 3, reference numeral 12 designates, as whole, a voltage-dependent resistor comprising, as its active element, a zinc oxide layer 13 having an electrode 16 and a bismuth oxide layer 14 and a zinc oxide layer 15 having an electrode 17.

Figure 4:
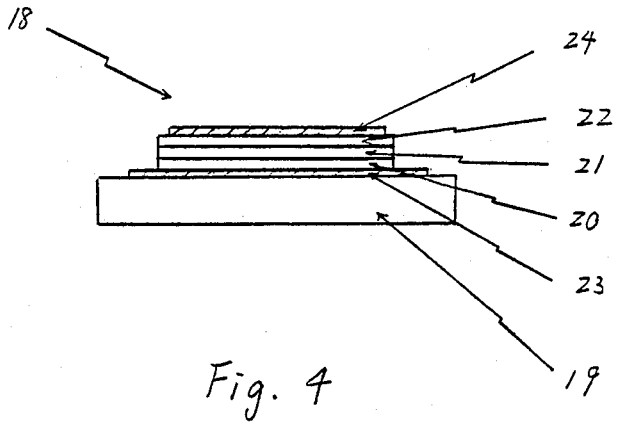
Figure 6:
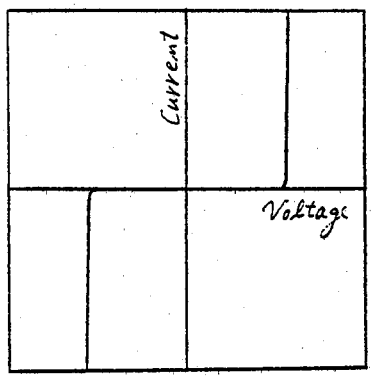

In FIG. 4, reference numeral 18 designates, as a whole, a voltage-dependent resistor comprising, as its active element, a zinc oxide layer 20 having an electrode 23 on a substrate 19 and a bismuth oxide layer 21 and a zinc oxide layer 22 having an electrode 24. Both FIGS. 3 and 4 show typical constructions of this invention having a symmetric voltage-current characteristics as shown in FIG. 6.

Figure 5:
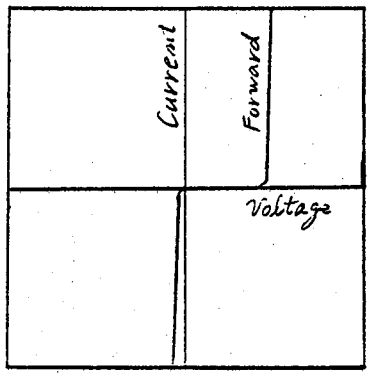
FIGS. 5 and 6 show two typical voltage-current characteristics of such voltage-dependent resistors.

In the application to DC voltage circuits, the voltage-dependent resistor having the asymmetric voltage-current characteristics as shown in FIG. 5 is useful. In the application to AC voltage circuits, the voltage-dependent resistor having the symmetric voltage-current characteristics as shown in FIG. 6 is useful.

The non-ohmic property of this invention is supposed to be attributable to a tunneling current through a barrier formed at an interface of the hetero-junction. Therefore, the non-ohmic property depends on the composition of metal oxide layer. Concerning the zinc oxide layer, any form is acceptable such as a sintered body, a deposited film and a single crystal, if the relative resistivity is adjusted to an appropriate value.

It has been discovered according to the invention that a voltage-dependent resistor comprising a zinc oxide layer or two zinc oxide layers and a bismuth oxide layer having additives at least one member selected from the group of 0.1~40 mole percent of cobalt oxide ($Co_2O_3$), 0.1~40 mole percent of manganese oxide ($MnO_2$), 0.1~3 mole percent of antimoney oxide ($Sb_2O_3$) and 0.1~17 mole percent of zinc oxide, with electrodes, has a non-ohmic property (voltage-dependent property) due to the hetero-junction between a zinc oxide layer and a metal oxide layer.

EXAMPLE 1

Zinc oxide and additives as shown in Tables 1 were mixed in a wet mill for 24 hours. Each of the mixtures was dried and pressed in a mold disc of 12 mm in diameter and 1.5 mm in thickness at a pressure of 250 kg/cm$^2$. The pressed bodies were sintered in air at 1250° C. for 2 hours, and then furnace-cooled to room temperature. Each sintered body was lapped at the opposite surfaces thereof by aluminum oxide fine powder to the mirror surfaces. After cleaning, each lapped body was set in a chamber of high frequency sputtering equipment with a target having a composition as shown in Table 2.

Then, a bismuth oxide layer was deposited on the lapped body by the conventional high frequency sputtering method in the atmosphere of Ar and oxygen. The sputtering time was set at the best condition for each composition between 10 minutes and 3 hours. The atmosphere during sputtering was usually set at from $1\times10^{-2}$ torr to $6\times10^{-2}$ torr. The deposited bismuth oxide layer on the lapped body had almost the same composition as the target having the composition shown in Table 2.

The high frequency sputtering method is as follows: a target and a substrate are set in a vacuum chamber opposedly. After introducing Ar gas (and oxygen) to an atmosphere of about $10^{-2}$ torr, a high frequency, high voltage is applied between the target and the substrate so that plasma is generated between them. The activated Ar ions caused by the plasma bombard the target so that the constituent of the target is knocked out of it. Then the constituent is deposited on the substrate. This method is used to make a thin film on a substrate in the field of semiconductor devices.

Each sputtered body was taken out of the chamber. Then aluminum electrodes were applied on the opposite surfaces of each sputtered body by the conventional vacuum deposition method. The resultant electroded devices had a structure as shown in FIG. 1, and the voltage-current characteristics as shown in FIG. 5, wherein the forward voltage-current characteristics was obtained when the electrode 4 on the zinc oxide body was biased positively.

The electrical characteristics of the resultant devices composed of a zinc oxide sintered body, a bismuth oxide layer and electrodes are shown in Table 3, which shows C-values at 1 mA/cm$^2$, n-values defined between 0.1 mA and 1 mA/cm$^2$ according to the equation (2), and the capacitances/mm$^3$. The electrical characteristics were improved by adding at least one member selected from the group consisting of 0.001~0.1 mole percent of aluminum oxide ($Al_2O_3$) and 0.001~0.1 mole percent of garium oxide ($Ga_2O_3$) to the zinc oxide layer and adding at least one member selected from the group consisting of 0.1~40 mole percent of cobalt oxide ($Co_2O_3$), 0.1~40 mole manganese oxide ($MnO_2$), 0.1~3 mole percent of antimoney oxide ($Sb_2O_3$) and 0.1~17 mole percent of zinc oxide (ZnO) to bismuth oxide.

Furthermore, the electrical characteristics were improved by adding at least one member selected from the group consisting of strontium oxide (SrO), barium oxide (BaO), chromium oxide ($Cr_2O_3$), tungsten oxide ($WO_3$), uranium oxide ($UO_2$), nickel oxide (NiO), silver oxide ($Ag_2O$), boron oxide ($B_2O_3$), silicon oxide ($SiO_2$), germanium oxide ($GeO_2$), tin oxide ($SnO_2$), lead oxide (PbO) and rare earth oxides such as praseodymium oxide ($Pr_2O_3$), neodymium oxide ($Nd_2O_3$) and samarium oxide ($Sm_2O_3$). The preferable amount of said additives were between 0.1 and 50 mole percent in total. When the amount of said additives was less than 0.1 mole percent, almost no effect was observed. When the amount of said additives was above 50 mole percent, bad effect such as smaller n-value was obtained.

EXAMPLE 2

A glass substrate with an aluminum electrode was set in a vacuum chamber of high frequency sputtering equipment with a zinc oxide target having a composition as shown in Table 1. Then, a zinc oxide layer was deposited on the electrode by the high frequency sputtering method in Ar atmosphere. The sputtering time was set between 30 minutes and 3 hours. The atmosphere during sputtering was in an order of $10^{-2}$ torr. The deposited zinc oxide layer on the electrode had almost the same composition as the target having the composition shown in Table 1.

After sputtering of the zinc oxide layer, a bismuth oxide layer was deposited on it by using a different target having a composition as shown in Table 2 by the high frequency sputtering method described in Example 1. Each sputtered body was taken out of the chamber. Then an aluminum electrode was applied on the bismuth oxide layer by the vacuum deposition method described in Example 1.

The result and devices had a structure as shown in FIG. 2 and the voltage current characteristics as shown in FIG. 5, wherein the forward voltage-current characteristics were obtained when the electrode 10 on the glass substrate was based positively.

The electrical characteristics of the resultant devices composed of a zinc oxide layer, a bismuth oxide layer, electrodes and a glass substrate are shown in Table 4, which shows C-values, n-values and capacitances. The electrical characteristics were improved by adding at least one member selected from the group consisting of 0.001~0.1 mole percent of aluminum oxide ($Al_2O_3$) and 0.001~0.1 mole percent of garium oxide ($Ga_2O_3$) to the zinc oxide layer and adding at least one member selected from the group consisting of 0.1~40 mole percent of cobalt oxide ($Co_2O_3$), 0.1~40 mole percent of manganese oxide ($MnO_2$), 0.1~3 mole percent of antimoney oxide ($Sb_2O_3$) and 0.1~17 mole percent of zinc oxide (ZnO) to bismuth oxide.

EXAMPLE 3

A zinc oxide sintered body having a composition as shown in Table 1 and a bismuth oxide layer having a composition as shown in Table 2 on the zinc oxide sintered body was made by the same process described in Example 1. Then a zinc oxide layer having a composition as shown in Table 1 was deposited on it by the same process described in Example 2. Then aluminum electrodes were applied on both zinc oxide layers as described in Example 2.

Each device had a structure as shown in FIG. 3 and the voltage-current characteristics as shown in FIG. 6.

The electrical characteristics of the resultant devices composed of a zinc oxide sintered body, a bismuth oxide layer and electrodes are shown in Table 5, which shows C-values, n-values and capacitances. The electrical characteristics were improved by adding at least one member selected from the group consisting of 0.001~0.1 mole percent of aluminum oxide ($Al_2O_3$) and 0.001~0.1 mole percent of garium oxide ($Ga_2O_3$) to the zinc oxide layer and adding at least one member selected from the group consisting of 0.1~40 mole percent of cobalt oxide ($Co_2O_3$), 0.1~40 mole percent of manganese oxide ($MnO_2$), 0.1~3 mole percent of antimony oxide ($Sb_2O_3$) and 0.1~17 mole percent of zinc oxide (ZnO) to the bismuth oxide layer.

EXAMPLE 4

A zinc oxide layer having a composition as shown in Table 1 on the aluminum electrode on a glass substrate and a bismuth oxide layer having a composition as shown in Table 2 on the zinc oxide layer was made by the same process described in Example 2. Then a zinc oxide layer having a composition as shown in Table 1 was deposited on it by the same process described in Example 2. Then an aluminum electrode was applied on the zinc oxide layer as described in Example 2.

Each device had a structure as shown in FIG. 4 and the voltage-current characteristics as shown in FIG. 6, wherein the forward voltage-current characteristics were obtained when the electrode 23 on the glass substrate was biased positively. The electrical characteristics of the resultant devices composed of two zinc oxide layers, a metal oxide layer and electrodes are shown in Table 6, which shows C-values, n-values and capacitances. The electrical characteristics was improved by adding at least one member selected from the group consisting of 0.001~0.1 mole percent of aluminum oxide ($Al_2O_3$) and 0.001~0.1 mole percent of garium oxide ($Ga_2O_3$) to the zinc oxide layer and adding at least one member selected from the group consisting of 0.1~40 mole percent of cobalt oxide ($Co_2O_3$), 0.1~40 mole percent of manganese oxide ($MnO_2$), 0.1~3 mole percent of antimony oxide ($Sb_2O_3$) and 0.1~17 mole percent of zinc oxide (ZnO) to the bismuth oxide layer.

Though only two types such as two layer structure consisting of a zinc oxide layer and a metal oxide layer and three layer structure consisting of two zinc oxide layers and a metal oxide layer are shown in those examples, one can easily obtain four layer structure consising of two zinc oxide layers and two metal oxide layers, five layer structure and more layer structure. These multilayer structure can be obtained by depositing zinc oxide layers and metal oxide layers by turns using sputtering method. As the deposited layer usually has destortion in it, heat treatment in the air after depositing is useful for stabilizing the electrical property. The most preferably temperature range for heat treatment is from 300° C. to 500° C.

TABLE 1

| Composition No. | Composition (mole percent) ZnO | $Al_2O_3$ | $Ga_2O_3$ |
|---|---|---|---|
| A-1 | 100 | | |
| A-2 | 99.999 | 0.001 | |
| A-3 | 99.99 | 0.01 | |
| A-4 | 99.9 | 0.1 | |
| A-5 | 99.999 | | 0.001 |
| A-6 | 99.99 | | 0.01 |
| A-7 | 99.9 | | 0.1 |
| A-8 | 99.98 | 0.01 | 0.01 |

TABLE 2

| Composition No. | Composition (mole percent) |
|---|---|
| B-1 | $Bi_2O_3$ |
| B-2 | $Bi_2O_3$(99.9) $Co_2O_3$(0.1) |
| B-3 | $Bi_2O_3$(99.0) $Co_2O_3$(1.0) |
| B-4 | $Bi_2O_3$(60) $Co_2O_3$(40) |
| B-5 | $Bi_2O_3$(99.9) $MnO_2$(0.1) |
| B-6 | $Bi_2O_3$(99.0) $MnO_2$(1.0) |
| B-7 | $Bi_2O_3$(60) $MnO_2$(40) |
| B-8 | $Bi_2O_3$(99.9) $Sb_2O_3$(0.1) |
| B-9 | $Bi_2O_3$(97.0) $Sb_2O_3$(3.0) |
| B-10 | $Bi_2O_3$(99.9) ZnO(0.1) |
| B-11 | $Bi_2O_3$(99.0) ZnO(1.0) |
| B-12 | $Bi_2O_3$(83.0) ZnO(17.0) |
| B-13 | $Bi_2O_3$(80.0) $Co_2O_3$(10.0) $MnO_2$(10.0) |
| B-14 | $Bi_2O_3$(67) $Co_2O_3$(10.0) $MnO_2$(10.0) $Sb_2O_3$(3.0) ZnO(10) |
| B-15 | $Bi_2O_3$(85) BaO(5) $Co_2O_3$(10) |
| B-16 | $Bi_2O_3$(85) SrO(5) $Co_2O_3$(10) |
| B-17 | $Bi_2O_3$(85) $Cr_2O_3$(5) $Co_2O_3$(10) |
| B-18 | $Bi_2O_3$(85) $WO_3$(5) $Co_2O_3$(10) |
| B-19 | $Bi_2O_3$(85) $VO_2$(5) $Co_2O_3$(10) |
| B-20 | $Bi_2O_3$(85) NiO(5) $Co_2O_3$(10) |
| B-21 | $Bi_2O_3$(85) $Ag_2O$(5) $Co_2O_3$(10) |
| B-22 | $Bi_2O_3$(85) $B_2O_3$(5) $Co_2O_3$(10) |
| B-23 | $Bi_2O_3$(85) $SiO_2$(5) $Co_2O_3$(10) |
| B-24 | $Bi_2O_3$(85) $GeO_2$(5) $Co_2O_3$(10) |
| B-25 | $Bi_2O_3$(85) $SnO_2$(5) $Co_2O_3$(10) |
| B-26 | $Bi_2O_3$(85) PbO(5) $Co_2O_3$(10) |
| B-27 | $Bi_2O_3$(85) $Pr_2O_3$(5) $Co_2O_3$(10) |
| B-28 | $Bi_2O_3$(85) $Sm_2O_3$(5) $Co_2O_3$(10) |
| B-29 | $Bi_2O_3$(85) $Nd_2O_3$(5) $Co_2O_3$(10) |

TABLE 3

| Composition No. of a zinc oxide layer | Composition No. of a bismuth oxide layer | C-value (V) | n-value | Capacitance (pF/mm$^2$) |
|---|---|---|---|---|
| A-1 | B-1 | 4 | 6 | 500 |
| A-1 | B-2 | 4 | 8 | 520 |
| A-1 | B-3 | 4 | 10 | 520 |
| A-1 | B-4 | 4 | 14 | 530 |
| A-1 | B-5 | 4 | 7 | 520 |
| A-1 | B-6 | 4 | 9 | 520 |
| A-1 | B-7 | 4 | 14 | 530 |
| A-1 | B-8 | 4 | 8 | 520 |
| A-1 | B-9 | 4 | 8 | 520 |
| A-1 | B-10 | 4 | 8 | 520 |
| A-1 | B-11 | 4 | 8 | 520 |
| A-1 | B-12 | 4 | 9 | 520 |
| A-1 | B-13 | 5 | 20 | 580 |
| A-1 | B-14 | 5 | 23 | 600 |
| A-1 | B-15 | 5 | 15 | 550 |
| A-1 | B-16 | 5 | 15 | 550 |
| A-1 | B-17 | 5 | 15 | 550 |

TABLE 3-continued

| Composition No. of a zinc oxide layer | Composition No. of a bismuth oxide layer | C-value (V) | n-value | Capacitance (pF/mm²) |
|---|---|---|---|---|
| A-1 | B-18 | 5 | 15 | 550 |
| A-1 | B-19 | 5 | 15 | 550 |
| A-1 | B-20 | 5 | 15 | 550 |
| A-1 | B-21 | 5 | 14 | 540 |
| A-1 | B-22 | 5 | 14 | 540 |
| A-1 | B-23 | 5 | 14 | 540 |
| A-1 | B-24 | 5 | 14 | 540 |
| A-1 | B-25 | 5 | 14 | 540 |
| A-1 | B-26 | 5 | 15 | 550 |
| A-1 | B-27 | 5 | 16 | 560 |
| A-1 | B-28 | 5 | 16 | 560 |
| A-1 | B-29 | 5 | 16 | 560 |
| A-2 | B-14 | 4 | 25 | 620 |
| A-3 | B-14 | 4 | 28 | 650 |
| A-4 | B-14 | 3 | 25 | 660 |
| A-5 | B-14 | 4 | 25 | 620 |
| A-6 | B-14 | 4 | 28 | 650 |
| A-7 | B-14 | 3 | 25 | 660 |
| A-8 | B-14 | 4 | 28 | 650 |

TABLE 4

| Composition No. of a zinc oxide layer | Composition No. of a bismuth oxide layer | C-value (V) | n-value | Capacitance (pF/mm²) |
|---|---|---|---|---|
| A-3 | B-1 | 4 | 8 | 530 |
| A-3 | B-2 | 4 | 10 | 540 |
| A-3 | B-3 | 4 | 12 | 540 |
| A-3 | B-4 | 4 | 16 | 550 |
| A-3 | B-5 | 4 | 8 | 540 |
| A-3 | B-6 | 4 | 10 | 550 |
| A-3 | B-7 | 4 | 16 | 560 |
| A-3 | B-8 | 4 | 10 | 550 |
| A-3 | B-9 | 4 | 10 | 550 |
| A-3 | B-10 | 4 | 10 | 550 |
| A-3 | B-11 | 4 | 10 | 550 |
| A-3 | B-12 | 4 | 11 | 560 |
| A-3 | B-13 | 5 | 25 | 590 |
| A-3 | B-14 | 5 | 28 | 650 |
| A-1 | B-14 | 6 | 20 | 600 |
| A-2 | B-14 | 5 | 25 | 620 |
| A-4 | B-14 | 3 | 25 | 660 |
| A-5 | B-14 | 5 | 25 | 620 |
| A-6 | B-14 | 4 | 28 | 660 |
| A-7 | B-14 | 3 | 25 | 670 |
| A-8 | B-14 | 4 | 28 | 660 |

TABLE 5

| Composition No. of zinc oxide layer | Composition No. of a bismuth oxide layer | C-value (V) | n-value | Capacitance (pF/mm²) |
|---|---|---|---|---|
| A-3 | B-1 | 5 | 8 | 270 |
| A-3 | B-2 | 5 | 10 | 270 |
| A-3 | B-3 | 5 | 12 | 280 |
| A-3 | B-4 | 5 | 16 | 280 |
| A-3 | B-5 | 5 | 8 | 270 |
| A-3 | B-6 | 5 | 10 | 280 |
| A-3 | B-7 | 5 | 16 | 280 |
| A-3 | B-8 | 5 | 10 | 280 |

TABLE 5-continued

| Composition No. of zinc oxide layer | Composition No. of a bismuth oxide layer | C-value (V) | n-value | Capacitance (pF/mm²) |
|---|---|---|---|---|
| A-3 | B-9 | 5 | 10 | 280 |
| A-3 | B-10 | 5 | 10 | 280 |
| A-3 | B-11 | 5 | 10 | 280 |
| A-3 | B-12 | 5 | 11 | 280 |
| A-3 | B-13 | 6 | 25 | 300 |
| A-3 | B-14 | 7 | 28 | 330 |
| A-1 | B-14 | 9 | 20 | 300 |
| A-2 | B-14 | 8 | 25 | 310 |
| A-4 | B-14 | 5 | 25 | 330 |
| A-5 | B-14 | 7 | 25 | 310 |
| A-6 | B-14 | 6 | 28 | 330 |
| A-7 | B-14 | 5 | 25 | 340 |
| A-8 | B-14 | 6 | 28 | 340 |

TABLE 6

| Composition No. of zinc oxide layer | Composition No. of a bismuth oxide layer | C-value (V) | n-value | Capacitance (pF/mm²) |
|---|---|---|---|---|
| A-3 | B-1 | 5 | 8 | 270 |
| A-3 | B-3 | 5 | 12 | 280 |
| A-3 | B-6 | 5 | 10 | 280 |
| A-3 | B-9 | 5 | 10 | 280 |
| A-3 | B-11 | 5 | 10 | 280 |
| A-3 | B-14 | 7 | 28 | 330 |
| A-3 | B-15 | 5 | 18 | 290 |
| A-3 | B-27 | 5 | 18 | 290 |

What is claimed is:

1. A voltage-dependent resistor of layered structure type, comprising at least one zinc oxide (ZnO) layer adjacent to at least one metal oxide layer consisting of 99.9~60 mole percent of bismuth oxide ($Bi_2O_3$) and at least one of the members selected from the group consisting of 0.1~40 mole percent of cobalt oxide ($Co_2O_3$), 0.1~40 mole percent of manganese oxide ($MnO_2$), 0.1~3.0 mole percent of antimony oxide ($Sb_2O_3$) and 0.1~17 mole percent of zinc oxide (ZnO) with electrodes applied to opposite surfaces.

2. A voltage-dependent resistor according to claim 1, wherein said zinc oxide layer composition comprises at least one of the members selected from the group consisting of 0.001 to 0.1 mole percent of aluminum oxide ($Al_2O_3$) and 0.001 to 0.1 mole percent of gallium oxide ($Ga_2O_3$).

3. A voltage-dependent resistor according to claim 1, wherein one of said zinc oxide layer comprises a sintered body of zinc oxide as a main constituent.

4. A voltage-dependent resistor according to claim 1, wherein said metal oxide layer is deposited by sputtering method.

5. A voltage-dependent resistor according to claim 1, wherein said metal oxide layer comprises at least one of the members selected from the group consisting of strontium oxide (SrO), barium oxide (BaO), chromium oxide ($Cr_2O_3$), tungsten oxide ($WO_3$), uranium oxide ($UO_2$), nickel oxide (NiO), silver oxide ($Ag_2O$), boron oxide ($B_2O_3$), silicon oxide ($SiO_2$), germanium oxide ($GeO_2$), tin oxide ($SnO_2$) lead oxide (PbO) and rare earth oxides.

* * * * *